United States Patent [19]

Kinkaid et al.

[11] 4,008,939

[45] Feb. 22, 1977

[54] AXIALLY CAMMED HOUSING FOR LOW INSERTION FORCE CONNECTOR

[75] Inventors: Robert John Kinkaid, New Cumberland; John Carl Asick, Harrisburg, both of Pa.

[73] Assignee: AMP Incorporated, Harrisburg, Pa.

[22] Filed: Sept. 17, 1974

[21] Appl. No.: 506,801

Related U.S. Application Data

[63] Continuation of Ser. No. 361,669, May 18, 1973, abandoned.

[52] U.S. Cl. ..... 339/75 M

[51] Int. Cl.[2] ..... H01R 13/54

[58] Field of Search ..... 339/75, 92, 176

[56] References Cited

UNITED STATES PATENTS

| | | | |
|---|---|---|---|
| 3,173,734 | 3/1965 | Hartwell | 339/92 M |
| 3,209,302 | 9/1965 | Uberbacher | 339/92 M |
| 3,474,387 | 10/1969 | Krum et al. | 339/92 M |
| 3,605,068 | 9/1971 | Rayburn | 339/49 R |
| 3,753,211 | 8/1973 | Pauza et al. | 339/75 MP |

FOREIGN PATENTS OR APPLICATIONS

| | | | |
|---|---|---|---|
| 2,014,868 | 10/1971 | Germany | 339/75 M |

*Primary Examiner*—Joseph H. McGlynn
*Attorney, Agent, or Firm*—Gerald K. Kita

[57] ABSTRACT

A two piece dielectric housing is connected together by a rotatable shaft. Electrical contacts within the first housing member have the end portions thereof protruding for receipt into the second housing portion. The second housing portion is provided with receptacle passageways therethrough for plugging the housing onto male electrical terminals. When the male electrical terminals are received within the housing, the shaft is rotated to retract the housing second portion partially into the housing first portion. Stationary cam surfaces on the housing second portion then engage upon the contacts and bias them into electrical engagement with the male electrical terminals inserted within the housing. Such structure permits the receipt of the male electrical terminals within the housing without initial engagement upon the electrical contacts therein. Subsequently the contacts are biased into engagement with the male electrical terminals once they are fully inserted within the housing.

2 Claims, 6 Drawing Figures

AXIALLY CAMMED HOUSING FOR LOW INSERTION FORCE CONNECTOR

This is a continuation of application Ser. No. 361,669 filed May 18, 1973, now abandoned.

The present invention relates to a low insertion force connector, and more particularly, to a connector in the form wherein a dielectric housing containing a plurality of electrical contacts is pluggably received over a number of male electrical terminals. The housing includes a camming portion which resiliently biases the contacts into electrical engagement with the male terminals after the terminals have been fully received within the housing. The advantage of the invention permits receipt of the male terminals with little or no resistance to insertion of the terminals, enabling ease in making a pluggable connection and eliminating damage and wear to the electrical components of the connector.

As another feature of the present invention, a sliding dielectric block is utilized to cam the electrical contacts within the dielectric housing. Such a feature permits the block to be fabricated with stationary camming surfaces thereby eliminating the need for a large number of moving parts which must be actuated to cam the contacts as desired.

In connectors of the prior art camming is typically accomplished by shifting the housing generally transverse to the pluggably received elongated male terminals. This is often undesirable, since the space allotted to allow for such shifting of the housing would be wasted. Other connectors designed in the prior art utilize cams which are actuated by a tool which must be inserted along side of the housing. In other designs the housing is provided with tool receiving receptacles into which the tool must be poked to enable actuation of the cams. Such designs have the drawback that a tool is a necessity and that sufficient space must be allotted around the housing to permit insertion of the tool and also visual inspection of the cams to verify correct actuation thereof by the tool. In the present invention, the housing is fabricated of two parts in tandem relationship. Actuation of the cams takes place by a partial retraction or telescoping of the two parts. Such telescoping displacement or retraction is in the direction along the lengths of the pluggably received male terminals, thereby eliminating the need to laterally shift the housing with respect to the contacts. Thus the need for wasted space around the periphery of the housing of the present invention is eliminated. Also, since camming is accomplished along the lengths of the male terminals, there is little probability of bending or otherwise damaging the terminals by shifts transverse to the terminals.

As a further feature of the present invention, the camming forces within the connector may be distributed to act in different directions such that there is no net force acting within the housing which would cause shifting of the housing or shifting of the electrical components contained within the housing. Thereby, according to the present invention, the connector is truly a static design wherein the constrained spring energy of the cammed electrical components may be distributed in different directions so as to eliminate any unstable static conditions during operation and use of the connector according to the present invention.

It is therefore an object of the present invention to provide a low insertion force connector wherein the electrical contacts of the connector are cammed to provide the desired electrical terminations while eliminating the need to supply the desired camming action by a lateral shift of the housing portion of the connector from its plugged position over a plurality of male electrical terminals received into the housing.

Another object of the present invention is to provide a low insertion force connector wherein the desired electrical terminations within the connector are made by positively camming the electrical contacts within the connector by slidably retracting or telescoping a portion of the housing along the same axis of motion by which the housing is moved to pluggably receive male electrical terminals therein.

Another object of the present invention is to provide a low insertion force connector wherein the housing thereof contains a retractable block which advantageously is provided with stationary camming surfaces which are utilized to positively cam electrical contacts contained within the housing into electrical engagement within male electrical terminals pluggably received within the housing.

Another object of the present invention is to provide a low insertion force connector wherein electrical contacts within a dielectric housing of the connector are positively cammed into electrical engagement with male electrical terminals pluggably received in the housing, and wherein the forces resulting from the desired camming are distributed in different directions so as to eliminate static instability of either the housing or the electrical components within the housing.

Other objects and many attendant advantages of the present invention will become apparent upon perusal of the following detailed description taken in conjunction with the accompanying drawings, wherein.

Figure 1:
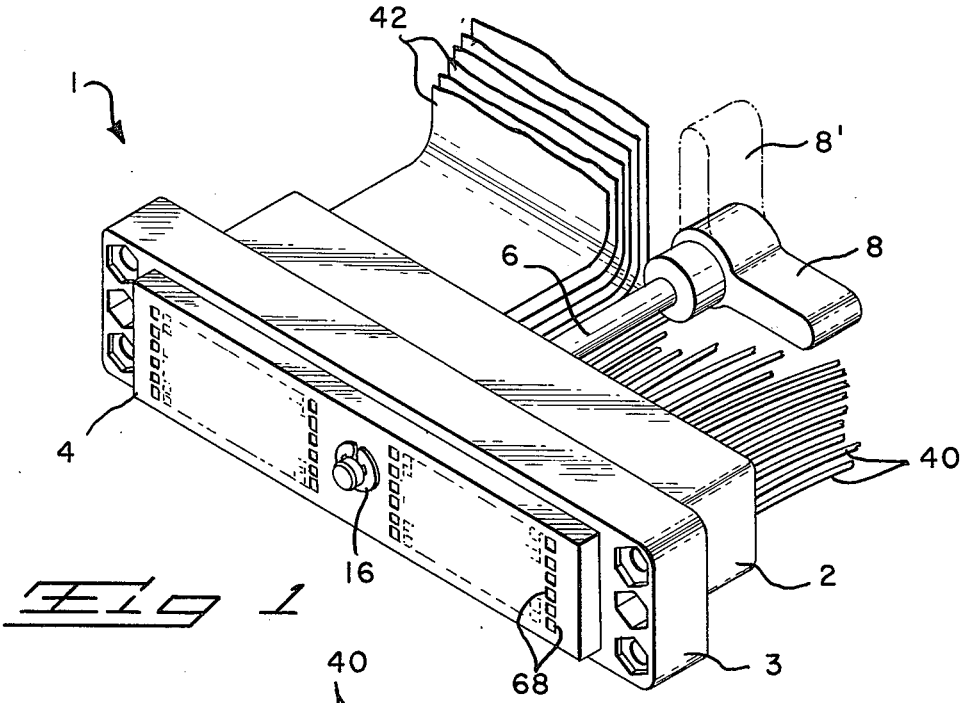
FIG. 1 is a fragmentary perspective of a preferred embodiment of the present invention illustrating adaptability for connection with various types of conductors.
Figure 6:
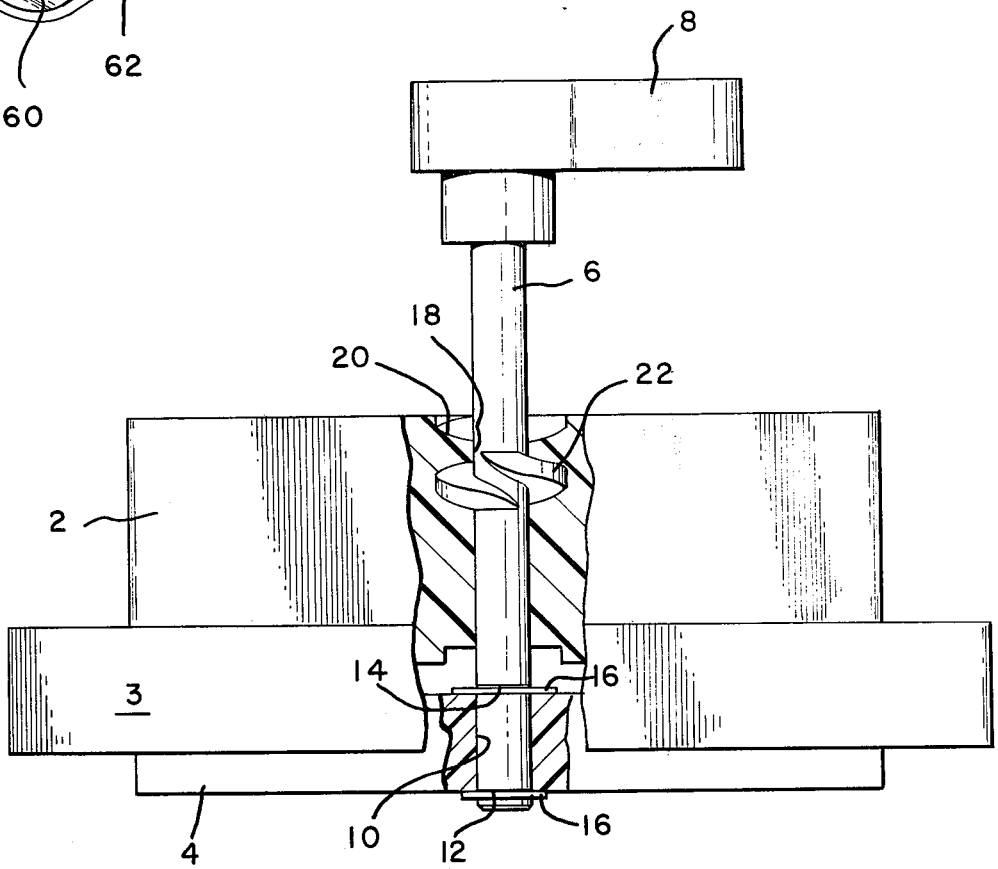
FIG. 6 is an enlarged elevation of the housing of the preferred embodiment with parts broken away and with parts in section to illustrate the operation of the cam and mounting member connecting together the two portions of the housing.

With more particular reference to the drawings, there is illustrated in FIG. 1 generally at 1 a preferred embodiment of a low insertion force connector according to the present invention. The preferred embodiment comprises a dielectric housing portion 2 having an encircling shroud 3 into which is telescoped or retracted another housing portion or block 4. A rotatable shaft 6 connects together the two dielectric housing portions 2 and 4 in a manner to be described in detail. The shaft 6 is provided at one end thereof with a pivotable lever arm 8. As shown more particularly in FIG. 6, the dielectric housing portion 4 is provided with a generally central bore 10 receiving rotatably the shaft 6 therethrough. The shaft 6 is provided with a pair of spaced circumferential grooves 12 and 14 located on either side of the housing portion 4 to receive split ring clips in the grooves 12 and 14. The clips 16 are of standard construction well known in the prior art and serve as fasteners retaining therebetween the housing portion 4 rotatably over the shaft 6 but at a fixed location along the length of the shaft. The housing portion 2 is also provided with a central bore 18 in alignment with the bore 10 of the housing portion 4 for rotatably receiving the shaft 6 therethrough. In addition, the bore 18 is internally threaded at 20 for a portion therealong in order to threadably receive therein a threaded portion 22 of the shaft 6 in the form of a helical worm gear configuration. By pivoting the arm 8 a quarter turn to its position illustrated in phantom outline at 8:, in FIG. 1, the shaft 6 is also rotated a quarter turn to advance the shaft along the internally threaded portion 20 and to thereby retract the housing portion 4 in telescoping relationship within the shroud 3 of housing portion 2. In similar fashion a quarter turn of the lever arm 8 in the opposite direction advances or projects the housing portion 4 from the housing portion 2 to its position shown in FIGS. 1 and 6.

Figure 2:
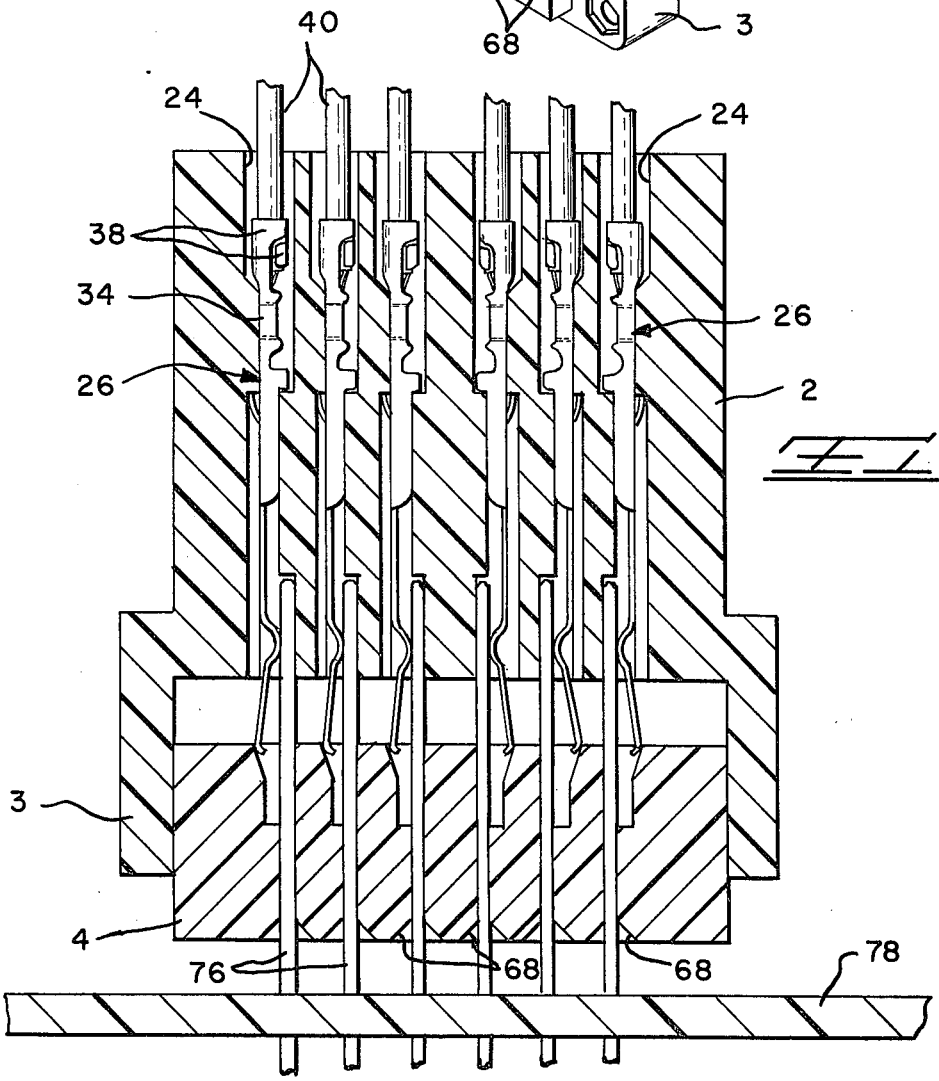
FIG. 2 is an enlarged elevation in section of a preferred embodiment of FIG. 1 illustrating such preferred embodiment in plugged connection over a plurality of male electrical terminals projecting from a printed circuit board.
Figure 5:
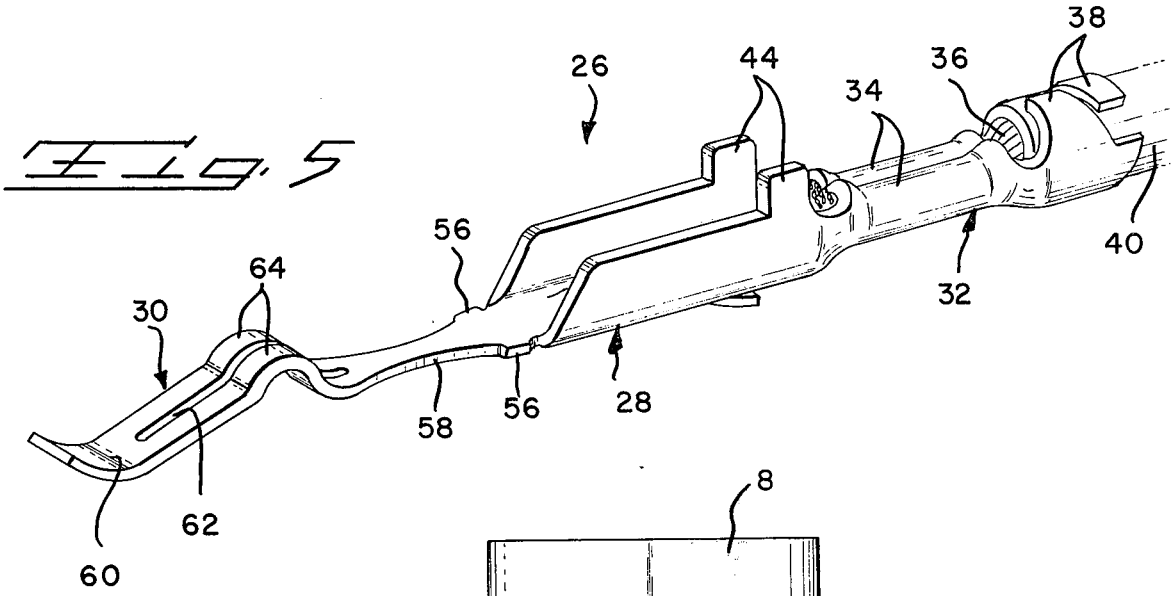
FIG. 5 is an enlarged perspective of an electrical contact for mounting within the housing of the connector according to the present invention.

As more particularly illustrated in FIGS. 2 and 5, the housing portion 2 is provided with a plurality of internal cavities therethrough, some of which are illustrated at 24. Disposed within each of the cavities 24 is an electrically conducting contact generally illustrated at 26. Each contact 26 is of a configuration having an elongated body portion generally illustrated at 28 with an integral resilient spring element 30 projecting longitudinally from one end of the body portion 28. The opposite end of the body portion 28 is provided with an integral crimping portion 32 which includes a pair of opposed tabs 34 for folding and crimping onto an exposed electrical conductor 36, with a second pair of opposed tabs 38 which are folded and crimped onto the insulation 40 from which the conductor 36 is exposed. It should be understood that the crimped portion 32 which is integral with the body portion 26 may be of any desired configuration permitting electrical termination of the terminal 26 to an individual conductor covered with insulation 40 as shown in FIGS. 1 and 2. In the alternative, any other type of prior art crimp portion may be substituted for the crimp portion 32 and thereby integrally provided on the terminal 26 to enable connection of the terminal 26 to a conductor which is arranged on or contained in a common dielectric carrier in the form of a sheet illustrated at 42. Such a dielectric carrier having the conductors arranged as described may comprise ribbon cable, flexible etched circuitry, matched impedance transmission line cable, flat flexible conductor cable, or the like. Accordingly, the use of the connector 1 is not limited by the type of conductors which are desired to be connected to the contacts 26 which are received in the cavities 24 of the housing 1.

Figure 3:
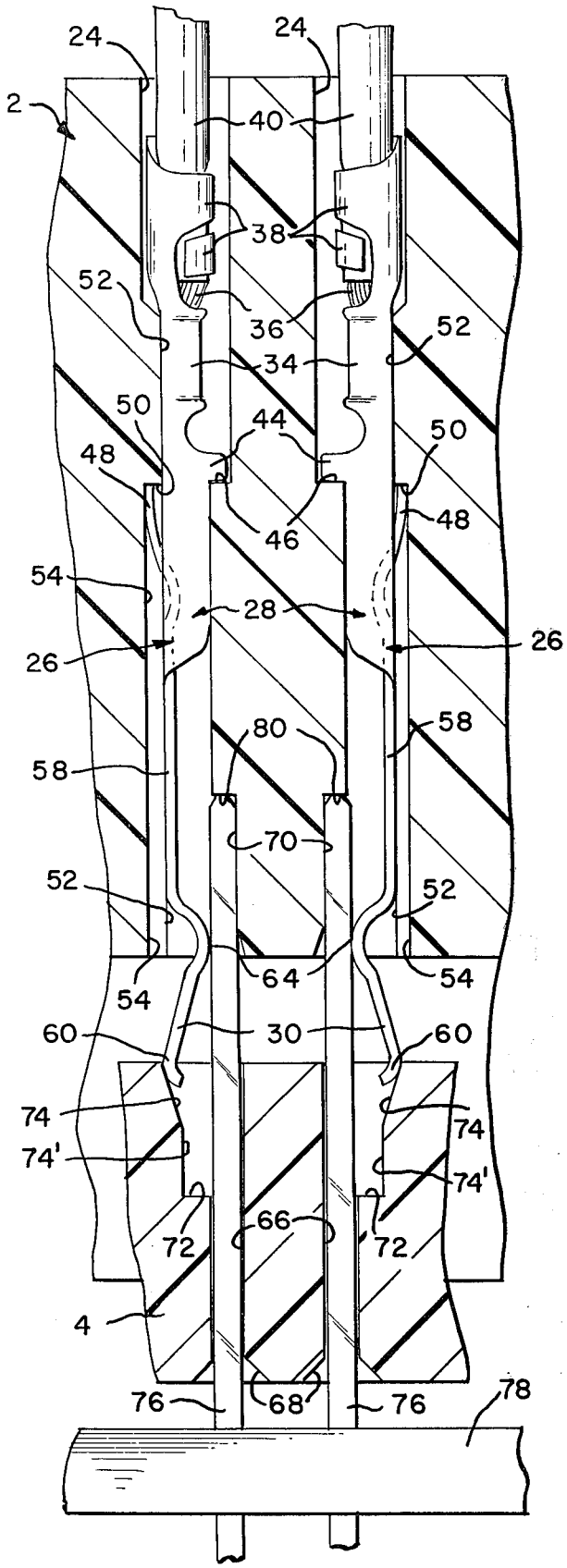
FIG. 3 is a fragmentary elevation in section of a greatly enlarged portion of the preferred embodiment shown in FIG. 2 illustrating the pluggable receipt of the male contacts within the housing prior to making an electrical termination with the contacts within the housing.
Figure 4:
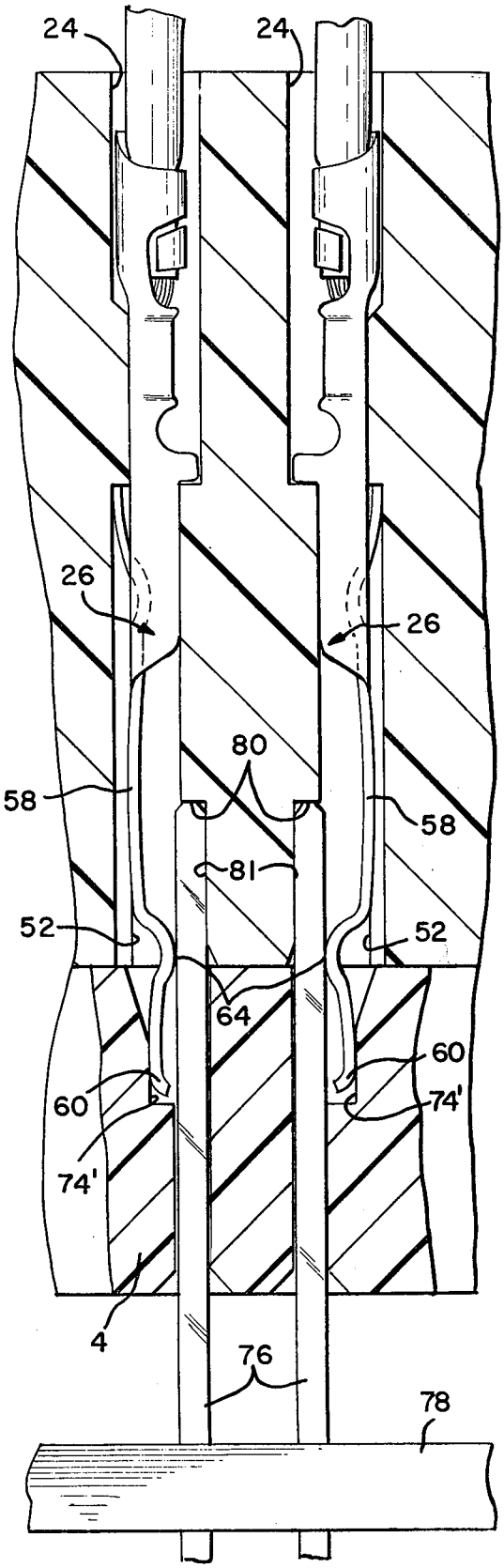
FIG. 4 is an enlarged fragmentary elevation in section of the embodiment shown in FIG. 3 with the electrical contacts of the preferred embodiment being positively cammed into electrical termination with the male electrical terminals projecting from the printed circuit board, subsequent to receipt of the male terminal within the housing.

Yet with reference to FIG. 5, taken in conjunction with FIGS. 2, 3 and 4, each terminal 26 is provided with a pair of tabs 44 which project laterally from the longitudinal axis of the body portion 28 and which are adapted to be seated against a first internal shoulder portion 46 within each of the cavities 24. In addition, each body portion 28 is provided with a generally diagonally projecting lance 48 in registration against another shoulder 50 provided in each cavity 24. As shown in FIGS. 2, 3 and 4, each terminal 26 is inserted vertically downward into a corresponding cavity 24 until the tabs 44 register against the internal shoulder 46. Additionally upon traverse of the terminal 26 into a corresponding cavity 24, an internal sidewall 52 of each cavity 42 will resiliently deflect the lance 48 into the body portion 28 to permit the free traverse or passage of the terminal 26 over the sidewall 52. However, once the tab portions 44 register against the internal shoulder 46, the lance 48 will have traversed into a slot or relieved portion 54 recessed in the sidewall 52, such that the lance 48 is allowed to spring resiliently outward from the body portion 28 into the slot 54 and into registration with the internal shoulder 50 at the end of the slot 54. In accordance with this procedure each terminal 26 is latchably secured within the corresponding cavity 24 with its lance 48 and the tabs 44 in registration against the corresponding shoulders 50 and 46 to prevent further motion within the housing portion 2.

With further reference to FIG. 5, taken in conjunction with FIGS. 2, 3 and 4, each contact 26 has the left spring element portion 30 in the form of a cantilever beam projecting longitudinally from the body portion 28. At the junction of the spring element portion 30 with the body portion 28 are provided a pair of opposed tabs 56 which impinge on opposite sides of the corresponding cavity 24 into which the contact 26 is inserted so as to laterally stabilize the spring element portion 30 of the contact within the cavity 24. Immediately adjacent to the tabs 56 each spring element 30 is provided with a reduced width neck portion 58 formed by opposing inwardly arcuate margins. The reduced neck portion 58 is specifically provided to reduce the stiffness in the spring element portion 30 and to enhance resilient bowing or deflection of the spring element 30 in the vicinity of the neck portion 58. The tip 60 of each spring element portion 30 is arcuate or curved in a first direction for a purpose to be described. The portion of each spring element 30 between the tip 60 and the neck portion 58 is bifurcated by a longitudinally extending slot 62 which provides a pair of contact surface portions 64 which are formed into an arcuate configuration and curved in a direction opposite to that of the tip 60.

As shown in FIGS. 2, 3 and 4, the spring element portions 30 at least partially protrude from the housing portion 2. The housing portion 4 is in the form of a dielectric block having a plurality of receptacle passageway portions 66 extending therethrough. The passageway portions 66 are generally parallel and extend entirely through the block 4. The ends of the passageway portions 66 are outwardly flared at 68 to provide funnel openings for a purpose to be hereinafter described in detail. As more particularly shown in FIGS. 2, 3 and 4, the housing portion 2 is provided with receptacle passageway portions 70 which are in alignment with corresponding receptacle passageway portions 66 in the block 4. Accordingly, the passageway portions 66 and 70 together comprise receptacle passageways extending through the block 4 and the housing portion 2. Thus the courses or paths of the receptacle passageways extends between the block 4 and the housing portion 2. It is also illustrated more particularly in FIGS. 2 and 3, that the block 4 in housing portion 2 are separated by a space illustrated between the block 4 and the housing 2. It is to be understood that the courses or paths of the receptacle passageways extend through such space as well as extend into the passageway portions 66 and 70 which are defined internally within the block 4 and housing portion 2.

As shown in FIGS. 2, 3 and 4, the block 4 is provided with a plurality of recesses 72 adjacent to and corresponding in number with the number of passageway portions 66 in the block 4. As shown the recesses 72 communicate with at least end portions of corresponding passageway portions 66. Each recess 72 is characterized with an internal sidewall defined by an outwardly flared or inclined surface 74 of the sidewall which is contiguous with a generally linear or planar surface 74: extending generally parallel to the longitudinal axes of the passageway portions 66.

By reference to FIGS. 2, 3 and 4, operation of the preferred embodiment will be disclosed in detail. The block 4 and housing portion 2 are first maintained in relative spaced apart condition shown in FIGS. 1, 2 and 3. As such, there is a space existing between the block 4 and the housing portion 2. In addition, the arcuate contact surfaces 64 of the spring elements 30 are retained out of the paths or courses of the receptacle passageways which are defined by the passageway portions 66 and 70. The housing 1 may thereby be pluggably received over a plurality of male electrical terminals, exemplary ones of which are illustrated at 76. For example, such terminals may be of the electrically conducting pin or post type projecting from a dielectric substrate such as a printed circuit board, a portion of which is illustrated at 78. It is, of course, to be understood that the terminals 76 may be of any other type desirable onto which a pluggable connection of the housing 1 is to be made. As shown in the drawings, the housing 1 is pluggably received over the exemplary terminals 76 which are received entirely through the passageway portions 66 of the block 4 and which project along the paths or courses of the receptacle passageways extending in the space between the block 4 and housing portion 2.

Since the passageway portions 66 are the only openings which are exposed from the block, insertion of the terminals 76 is accomplished without danger of engaging the terminals accidently against the spring elements 30. The passageway portions 66 are of substantial length for supporting substantial lengths of the terminals 76 as they are inserted in the block 4. The danger of bending the terminals or otherwise damaging them is greatly reduced thereby. Also, the terminals 76 are substantially received internally of the block 4 before they are introduced in the vicinity of the contact spring element portions 30. The terminals 76 are thereby captured in the passageway portions 66 without any danger of their being projected toward undesired directions upon receipt in the housing. The sidewalls of the passageway portions 66 thereby align, guide and support the terminals along substantial lengths thereof before the terminals are fully inserted toward the recesses 72; the spring element portions 30 and the housing portion 2. The terminals 76 thus continue along the paths or courses of the receptacle passageways until they are received within the receptacle passageway portions 70 of the housing portions 2. It is noted, particularly with reference to FIG. 3, that the passageway portions 70 terminate in end walls 80 against which the ends of the terminals 76 become seated in order to limit further insertion of the terminals 76 within the receptacle passageways defined by the passageway portions 66 and 70. Also as shown in FIGS. 2 and 3, the arcuate contact portions 64 of the spring element portions 30 of the contacts 26 are laterally adjacent to the terminals 76 received into the passageway portions 66 and 70. It is desirable, however, that the terminals 76 slightly scrape or otherwise slightly wipe across the surfaces 64 in order to provide a slight cleaning action as the terminals are inserted or otherwise pluggably received within the receptacle passageways of the housing 1. Thus as shown in FIG. 3, the contact surfaces 64 are slightly impinged laterally against the terminals 76 when the terminals are initially plugged into or received within the passageway portions 70 and 66 of the receptacle passageways in the housing 1. It is however to be understood that the terminal surfaces 64 may also be retained within the housing portion 2 such that a clearance between the surfaces 64 and the terminals 76 may be initially provided for in order to eliminate such wiping action as described.

Yet with reference to FIGS. 2 and 3, the block 4 is illustrated as initially receiving the arcuate tips 60 of the contacts against the inclined camming surfaces 74. Thus by initially receiving the tips 60 at least partially within the recesses 72 of the block 4, the tips 60 are protected from being accidentally stubbed against the outside surfaces of the block or deflected into the space initially existing between the block 4 and the housing portion 2. It is however to be understood that the tips 60 may also be retained merely in position protruding from the housing portion 2 without the necessity for the tips being also initially received in the recesses of the block 4. The tips 60 are also projected diagonally away from the paths or courses of the passageways to eliminate snubbing against the terminals 76 as they are inserted.

Once the male terminals 75 are fully inserted or received within the receptacle passageways, the lever 8 may be actuated to its position shown at 8: in FIG. 1, to rotate the shaft 6 a quarter turn and thereby threadably advance the worm gear portion 22 within the internally threaded portion 20 of the housing portion 2. This procedure will then retract or telescope or otherwise displace the block 4 in a direction generally towards the housing portion 2. Thus the space initially provided for between the block 4 and the housing portion 2 is greatly reduced or alternatively eliminated upon retraction of the block 4.

As the block is retracted, the cam surfaces 74 impinge against the arcuate tips 60, the arcuate configuration preventing snubbing or stubbing of the tips 60 against the block 4. The tips 60 are forced to traverse over the inclined cam surfaces 74 as the block 4 is retracted, thereby resiliently deflecting by cantilever action the spring element portions 30 of the contacts 26. As shown by reference to FIGS. 3 and 4, substantial cantilever deflection or otherwise resilient bending of the contacts 26 occurs at their respective narrowed neck portions 58. During cantilever deflection, a substantial length of each of the contacts 26 remains in abutment against the corresponding sidewall 52 of each of the cavities 26 provided in the housing portion 2. This assures correct alignment of the contacts and also assures that substantial contact pressure will be created between the contact surfaces 64 and the corresponding terminals 76. More particularly, cantilever deflection of the contacts 26 causes the contact surfaces 64 of the spring element portions 30 to be resiliently deflected by cantilever action into engagement against the corresponding terminals 76 with a substantial pressure created at the points of engagement between the terminals 76 and the contact surfaces 64 to assure good mechanical and electrical connections. The terminals 76 are impinged laterally against the sidewalls 81 of the passageway portions 70, further to increase the engagement pressure and to support the terminals against deflection or bending. As a further feature, as the tips 60 of the contacts are forced to traverse over the inclined cam surfaces 74, the cam surfaces 74 supply a force component acting vertically, as shown in the drawings in FIGS. 3 and 4, or longitudinally along the axis of the contacts 26. The reduced neck 58 enhances resilient deflection in that area to prevent overstressing and overbending in the areas 60 and 64 of the terminal. The resilient deflection is thereby distributed to either side of the areas 64, causing the arcuate contact surfaces 64 to resiliently roll or curl a very slight amount in response to the longitudinal force component while in engagement with the terminals 76. As shown in FIG. 4, as the block 4 is continued to be retracted, the tips 60 will continue to traverse over the cam surfaces 74'. Since the surfaces 74' are longitudinally of the contacts 26, the longitudinal force components become relieved, allowing the contact surfaces 64 to uncurl. Such action occurs when the contact surfaces 64 are in engagement against the sides of the terminals 76. Thus the surfaces 64 will slightly roll over the surfaces of the terminals 76 to provide a slight wiping action which improves electrical continuity at the points of engagement. The bifurcation 62 in each spring element portion 30 assures that a plurality of contact surfaces 64 are provided on each spring element which operate independent of each other in order to increase the number of points of engagement with the terminals 76. In addition, the cam surfaces 74' also extend in directions parallel to the longitudinal axes of the elongated male terminals 76. Thus, the forces of the camming surfaces 74' against the spring element portions 30 act transversely with respect to or generally perpendicular with respect to the longitudinal axes of the male terminals 76. This permits the contacts to be oriented in different directions such that the camming forces oppose one another leaving no net force in any direction which would cause a lateral shift of any housing portion, the housing portion 2 or the block 4, in a direction transverse to the longitudinal axes of the male terminals 76. In addition, any camming forces acting longitudinally along the contacts 26 are eliminated when the tips 60 of the contacts are in registration against the camming surfaces 74'. The camming forces thus provided by the camming surfaces 74' are transverse to the direction of displacement of the block 4 with respect to the housing portion block purposely to eliminate any forces acting in the direction of such displacement, which would tend to resist such displacement, and which would tend to cause undesired separation between the bock 4 and the housing portion 2. Accordingly, the connector is a truly static design wherein the constrained resilient spring energy of the cammed resilient electrical contacts and other electrical components are distributed in different directions so as to eliminate any unstable static conditions during operation and use of the connector. Since the camming action is caused by displacement of the block 4 along the lengths of the male terminals, there is little probability of bending or otherwise damaging the terminals by shifts or displacements transverse to the longitudinal axes of the terminals. In addition, since retraction or telescoping displacement is in the direction along the lengths of the pluggably received male terminals, there is no need to laterally shift the housing with respect to the contacts. Thus, the need for wasted space around the periphery of the housing 1 is eliminated.

The cam operator in the form of the threaded shaft 6 and associated lever arm 8 is located in tandem relationship with respect to the housing portions 1 and 4, which are also located in tandem relationship. Thus actuation of the camming mechanism is accomplished by rotation of the shaft 6 without the need for additional tools, heretofore utilized in prior art designs. The fact that all the parts are in tandem relationship permits use of the connector 1 in closely confined spaces. More particularly, in every environment of use for a pluggable connector there is always sufficient room provided to enable motion of the connector toward the male contacts so as to effect a desired plugging connection. After the plugging connection is accomplished, such room is usually occupied by the conductors 40 and 42 terminated to the contacts 26 within the housing 1. In addition, the tandem shaft 6 and lever arm 8 of the present invention is designed for occupying such room, thereby utilizing the always available room for the operator which provides the camming mechanism. Therefore, the available room is utilized without a need for providing additional wasted space for tools as is heretofore required in the prior art designs.

The block 4 is the only moving part required to cam the contacts 26. The block is thereby advantageously provided with stationary cam surfaces 74 and 74' thus eliminating additional movable cam parts. The stationary surfaces may be provided at low fabrication cost by molding them when fabricating the block.

The contact tips 60 remain in resilient compression against the surfaces 74' to provide a follow-up force on the posts 76 if they should experience creeping while against the housing sidewalls 70. Any vibration experienced during use will only cause the terminal tips 60 to slide back and forth slightly along the surfaces 74', which, since they extend longitudinally parallel to the posts 76, the tips 60 are allowed to freely slide back and forth thereover to relieve and thereby damp out the vibration in the contacts 30 to prevent contact chatter.

Although a preferred embodiment of the present invention has been illustrated and described in detail, it is 2, be understood that other preferred embodiments and modifications thereof which would be obvious to one having ordinary skill in the art are intended to be covered in the spirit block scope of the appended claims, wherein:

We claim:

1. In a low insertion force connector having a plurality of single resilient element electrical contacts in a housing capable of receiving a plurality of male electrical terminals which are initially disconnected from the electrical contacts in the housing, and a cam structure for camming said single resilient elements of said electrical contacts into mechanical and electrical engagement with said received male terminals subsequent to receipt of said male terminals in the housing, the improvement comprising:

said housing being fabricated in two portions, a first portion of said housing having first receptacle passageways extending therethrough, a second portion of said housing having second receptacle passageways therein in alignment with said first receptacle passageways of said housing first portion, the second receptacle passageways of said housing second portion terminating in end walls against which said male terminals are seated when received in said receptacle passageways of both said housing first and second portions, said housing first portion having cam surfaces on said cam structure for engagement against said single resilient elements, said housing first portion being displaceable in a direction toward said housing second portion and along the lengths of said male terminals to engage said cam surfaces against said single resilient elements and to bias thereby said single resilient elements into engagement with said male terminals, and said housing second portion engaging and supporting said received male terminals in said second receptacle passageways during engagement of said single resilient elements with said male terminals.

2. The structure as recited in claim 1, wherein, said electrical contacts are single cantilever leaf spring elements having arcuate tips engageable on said cam surfaces, said electrical contacts further having arcuate portions spaced from said arcuate tips and arcuate in opposite directions with respect to said tips, whereby compression forces of said cam surfaces on said tips are transmitted into arcuate bending of said arcuate portions to provide a rolling action of the surfaces of said arcuate portions against said male electrical terminals.

* * * * *